United States Patent [19]

Akai

[11] 4,209,946

[45] Jul. 1, 1980

[54] PIVOT MECHANISM FOR PIVOTED WINDOWS

[75] Inventor: Tsutomu Akai, Kurobe, Japan

[73] Assignee: Yoshida Kogyo K.K., Tokyo, Japan

[21] Appl. No.: 926,910

[22] Filed: Jul. 21, 1978

[30] Foreign Application Priority Data

Aug. 5, 1977 [JP] Japan ..... 52-105446[U]
Aug. 5, 1977 [JP] Japan ..... 52-105447[U]

[51] Int. Cl.[2] ..... E06B 3/40
[52] U.S. Cl. ..... 49/390; 16/130
[58] Field of Search ..... 49/390, 391, 392, 393, 49/388; 16/129–132

[56] References Cited

U.S. PATENT DOCUMENTS

| | | | |
|---|---|---|---|
| 2,583,950 | 1/1952 | Kirschner | 16/129 |
| 2,923,036 | 2/1960 | Beyrle | 49/388 |
| 2,987,756 | 6/1961 | Hollansworth | 16/129 X |
| 3,021,555 | 2/1962 | Hogedal | 49/390 X |
| 3,251,088 | 5/1966 | Boundy | 16/130 X |
| 3,325,942 | 6/1967 | Bejarano | 49/388 X |
| 3,584,332 | 6/1971 | Taylor | 16/130 |
| 3,911,623 | 10/1975 | Walter | 49/390 |
| 4,142,272 | 3/1979 | Oogami et al. | 49/390 X |

*Primary Examiner*—Philip C. Kannan
*Attorney, Agent, or Firm*—Bucknam and Archer

[57] ABSTRACT

A pivot mechanism for pivoted or reversible windows includes a stationary base adapted to be secured to a window frame member and a slide base slidably mounted on the stationary base and with which a window sash edge is pivotally engageable. A screw threadedly extends through one of the bases and is coupled with the other base by means of a pair of annular flanges on one end of the screw, between which is received a pair of arms extending from the other base. By turning the screw, the slide base is moved with respect to the stationary base, thereby providing a bearing for a pivot shaft on the window sash edge or positionally adjusting a pivot shaft on the slide base.

4 Claims, 13 Drawing Figures

PIVOT MECHANISM FOR PIVOTED WINDOWS

BACKGROUND OF THE INVENTION

1. Field of the Invention

The present invention relates to a pivot mechanism for pivoted windows.

2. Prior Art

Various problems have generally been experienced with conventional pivoted or reversible windows. For example, there are chances for the opposed pivots or pivot bearings to get fixed out of mutual alignment and the window sash becomes inclined with respect to the window frame. It is troublesome or sometimes impossible to detach and re-install such pivot devices for accurate positional adjustment of the window sash. Further, assembling the window sash into the window frame so as to be pivotable therein has been a tedious and time-consuming procedure.

SUMMARY OF THE INVENTION

A pivot machanism includes a stationary base adapted to be secured to a window frame member, a slide base slidably mounted on the stationary base for pivotal engagement with a window sash edge that is pivotally movable with respect to the window frame member. A threaded element threadedly extends through one of the bases longitudinally of the window frame member, and is coupled with the other base, the threaded element being rotatable about its axis so that turning the threaded element enables the slide base to move relatively to the stationary base in the longitudinal direction of the window frame member.

It is an object of the present invention to provide a pivot mechanism for pivoted windows which is positionally adjustable for correct installation of the window sash.

Another object of the present invention is to provide a pivot mechanism for pivoted windows which permits the window sash to be easily mounted in the window frame.

Many other advantages and features of the present invention will become manifest to those versed in the art upon making reference to the detailed description and the accompanying sheets of drawings in which preferred structural embodments incorporating the principles of the present invention are shown by way of example.

DETAILED DESCRIPTION

Figure 1:
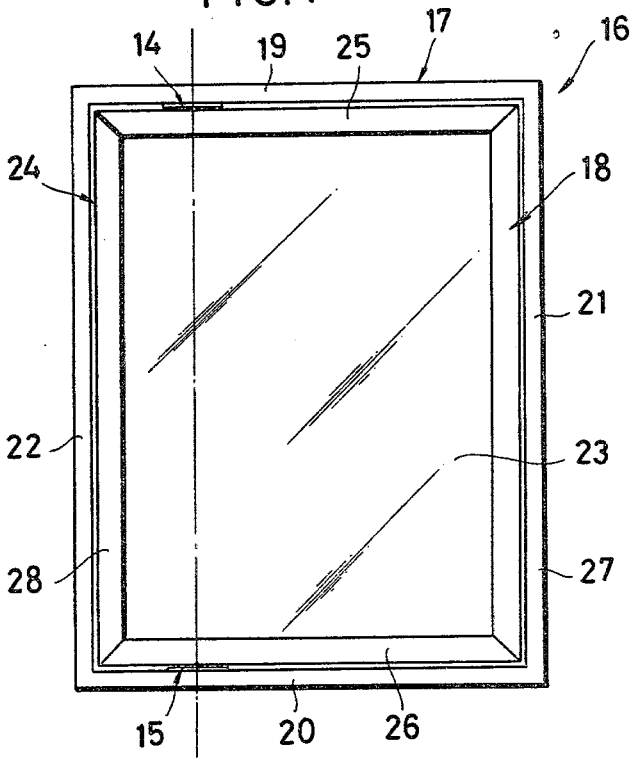
FIG. 1 is a front elevational view of a vertically pivoted window utilizing a pair of pivot mechanisms constructed according to the present invention.

The principles of the present invention are particularly useful when embodied in a pair of pivot mechanisms as shown in FIG. 1 generally indicated by the numerals 14 and 15.

The pivot mechanisms 14 and 15 are incorporated in a vertically pivoted or reversible window assembly 16 including a window frame 17 and a window sash 18 pivotally swingable in the window frame 17. The window frame 17 includes a header 19 and a sill 20 at the top and bottom thereof and a pair of side jambs 21, 22 secured at their ends to the header 19 and sill 20, the window frame 17 being mounted in a building opening (not shown). The window sash 18 includes a panel or panel 23 of glass or any other suitable material and a frame 24 extending around and embracing the periphery of the panel 23, the sash frame 24 being composed of a pair of upper and lower horizontal members 25, 26 and a pair of vertical members 27, 28 coupled at their ends to the horizontal members 25, 26.

The pivot mechanism 14 is disposed between the header 19 of the window frame 17 and the upper horizontal member 25 of the sash frame 24, and the pivot mechanism 15 is disposed between the sill 20 of the window frame 17 and the lower horizontal member 26 of the sash frame 24. The pivot mechanisms 14, 15 are held in vertical alignment with each other and are off-center with respect to the window assembly 16 so that they are located closer to one of the side jambs 22.

Figure 2:
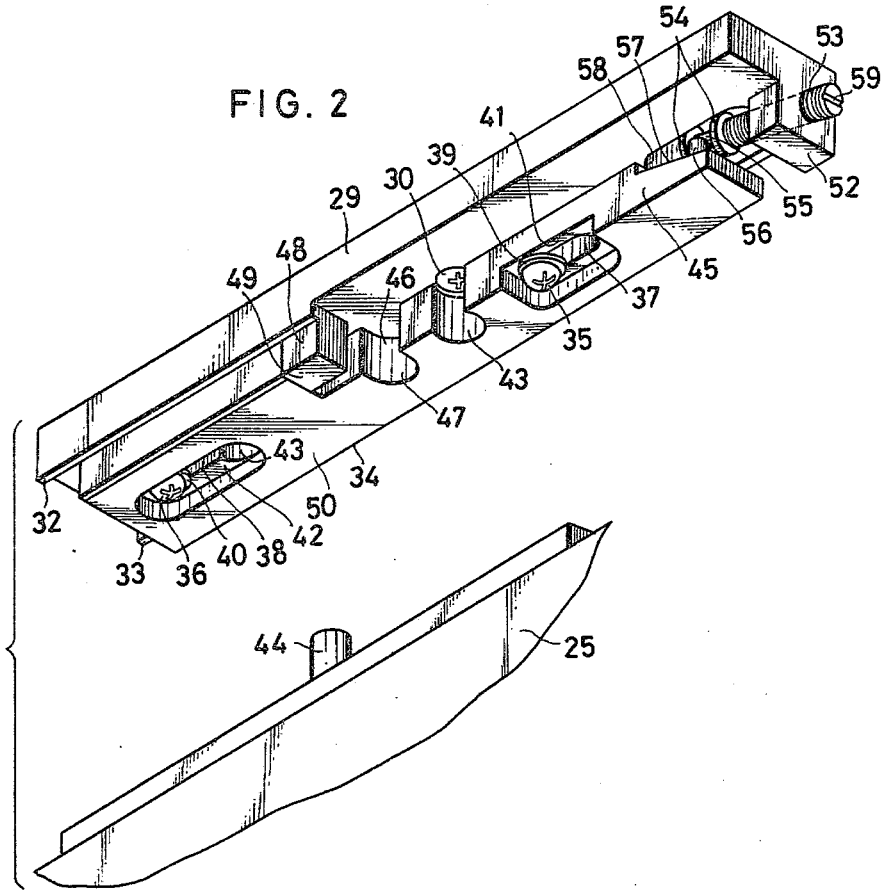
FIG. 2 is an enlarged perspective view of a pivot mechanism according to an embodiment.
Figure 4:
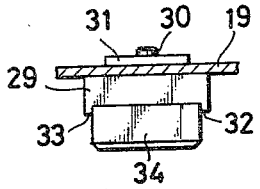
FIG. 4, on sheet 2, is a side elevational view of the pivot mechanism, viewed from the left side of FIG. 3.
Figure 3:
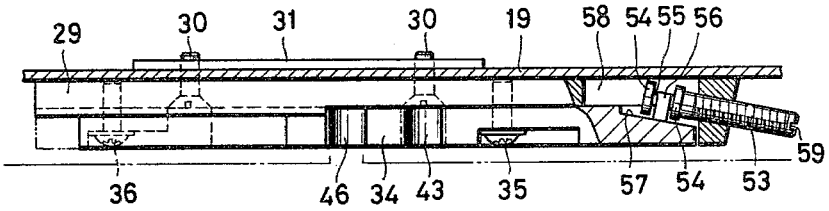
FIG. 3 is a front elevational view, partly in cross section, of the pivot mechanism shown in FIG. 2.

FIGS. 2 through 4 show a structure suitable for use as the upper pivot mechanism 14 in FIG. 1. The pivot structure comrises an elongate stationary base 29 secured to the header 19 by means of a pair of screws 30, 30, there being a reinforcing plate 31 backing up the header 19. The stationary base 29 has longitudinal side flanges 32, 33 projecting downwardly therefrom, between which extends an elongate slide base 34 slidably mounted on the stationary base 29. The slide base 34 is placed on the surface of the stationary base 29 which is remote from the header 19. The slide base 34 is attached relatively to the stationary base 29 by means of a pair of screws 35, 36 extending loosely through a pair of oblong holes or slots 37, 38, respectively, in the slide base 34 threadedly into the slide base 29, the slots 37, 38 being elongated in the longitudinal direction of the slide base 34. A pair of washers 30, 40 are interposed between the head of the screw 35 and a shoulder 41 around the slot 37, and between the head of the screw 36 and a shoulder 42 around the slot 38, respectively. Upon loosening of the screws 35, 36, the slide base 34 is longitudinally shiftable, the extent of the longitudinal movement being determined by the length of the slot 37.

The screws 30, 30 can be inserted respectively through recess 43, 43 in the slide base 34 threadedly into the stationary base 29.

The pivot structure further includes a pivot shaft 44 mounted on and projecting upwardly from the upper horizontal member 25 toward the header 19.

There is an elongate indentation 45 in one side of the slide base 34, the indentation 45 extending in the longitudinal direction in which the slide base 34 is movable. The slide base 34 has a substantially semicircular or U-shaped recess 46 defined by a curved wall 47 and opening toward the elongate indentation 45, the recess 46 being receptive of the pivot shaft 44. The stationary base 29 has a block 48 projecting downwardly to the extent that its end face 49 lies substantially flush with the lower surface 50 of the slide base 34. The block 48 is located in the indentation 45 and has a vertical flat surface 51 (FIGS. 5 and 6) facing and located closely to the side surface bordering the indentation 45.

As best shown in FIGS. 2 and 3, a vertical wall 52 extends downwardly from one end of the stationary base 29, and is located in the path of movement of the slide base 34. A threaded element or screw 53 threadedly extends through the end wall 52 at an angle with respect to the path of the movement of the slide base 34. The screw 53 and the slide base 34 are coupled together to enable the longitudinal movement of the slide base 34 upon rotation of the screw 53 about its axis. To effect such coupling, the screw 53 has on its one end a pair of spaced annular flanges 54, 54 between which extends a smaller-diameter rod portion 55 of the screw 53, which is sandwiched between a pair of arms 56, 56 projecting substantially perpendicularly from a slanted surface 57 on the slide base 34. Turning the screw 53 about its axis causes the flanges 54, 54 to move axially with the screw 53, and hence the arms 56, 56 to be forcibly displaced by engagement with one of the flanges 54. The slanted surface 57 extends substantially parallel to the axis of the screw 53. The stationary base 29 has a cavity 58 disposed adjacent to the end wall 52 and acting as a room accommodating the flanges 54, 54 on the screw 53 and the arms 56, 56 on the slide base 34.

The end of the screw 53 which is remote from the flanges 54, 54 has a slot 59 for receiving the wedges-shaped tip of a screwdriver bit. With the screw 53 inclined, the manual turning of the screwdriver is relatively easy because the screwdriver handle when manipulated is spaced away from the header 19 of the window frame 17.

Figure 5:
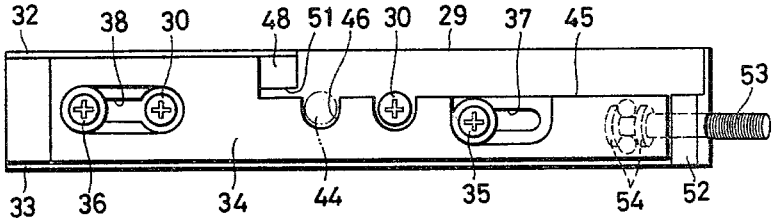
FIG. 5, on sheet 3, is a bottom view of the pivot mechanism of FIG. 3, showing a slide base before adjusting movement.
Figure 6:
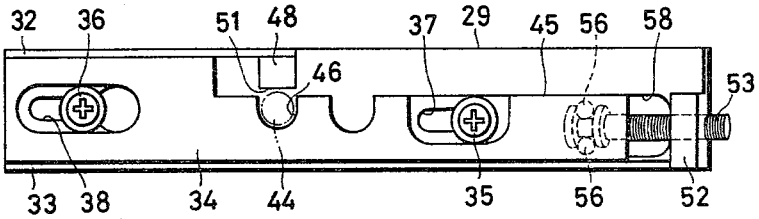
FIG. 6, on sheet 3, is a view similar to FIG. 5, showing the slide base after adjustment.
Figure 7:
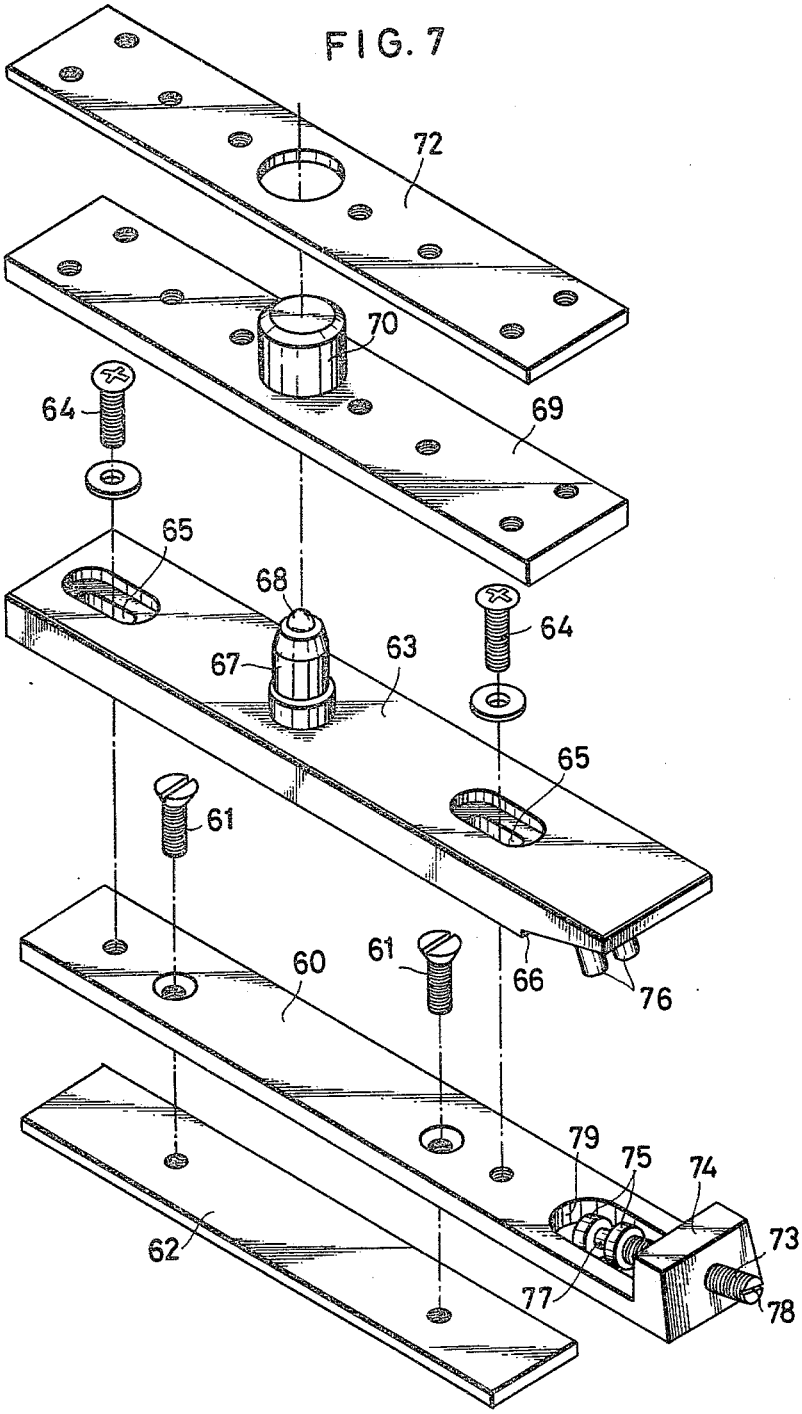
FIG. 7 is an enlarged exploded perspective view of another embodiment.

When the slide base 34 is in the position shown in FIG. 5, that is, the left ends of the slots 37, 38 are held against the screws 35, 36, respectively, the semicircular recess 46 is located in a position out of registration with the block 48 such that the recess 46 opens toward the indentation 45. As the screw 53 is turned so as to be driven in until the slide base 34 is moved leftward as viewed in FIG. 6 to bring the right end of the slot 37 into abutting engagement with the screw 35 extending there-through, the semicircular recess 46 becomes positioned in registration with the block 48, whereupon the flat surface 51 of the block 48 substantially closes the semicircular recess 46. Thus, the flat surface 51 of the block 48 and the recess-bounding curved wall 47 jointly provide a bearing for the pivot shaft 44 (also schematically illustrated in FIGS. 5 and 6) on the upper frame member 25 of the window sash 18.

A structure for use as the lower pivot mechanism 15 of FIG. 1 is illustrated in FIGS. 7 through 10, and comprises an elongate stationary base 60 fixed to the sill 20 (omitted for clarity in FIG. 7) by means of a pair of screws 61, 61, the sill 20 being backed up by a reinforcing plate 62. Slidably disposed on the surface of the stationary base 60 which is remote from the sill 20 is an elongate slide base 63 attached to the stationary base 60 by means of a pair of washered screws 64, 64 extending loosely through a pair of oblong holes or slots 65, 65, respectively, in the slide base 63 threadedly into the stationary base 60. The slots 65, 65 are elongated in the longitudinal direction of the slide base 63. With the screws 64, 64 loosened, the slide base 63 is longitudinally movable to the extent that is established by the length of the slots 65, 65. The slide base 63 has a pair of side flanges 66, 66 projecting downwardly so as to be disposed one on each side of the stationary base 60 for guiding the longitudinal movement of the slide base 63 on the stationary base 60. A pedestaled pivot shaft 67 projects from the slide base 63 in a direction away from the stationary base 60, the pivot shaft 67 carrying a ball 68 in its distal end.

Figure 8:
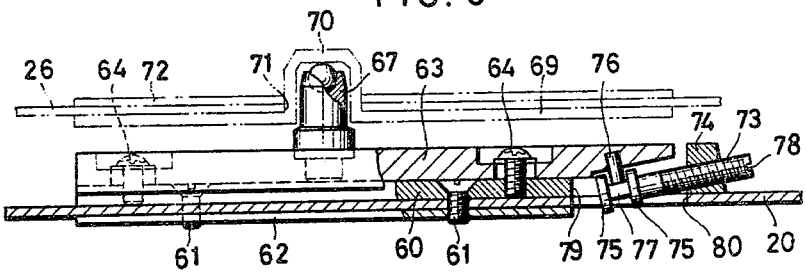
FIG. 8 is a front elevational view, with parts shown cross-sectionally, of the pivot mechanism shown in FIG. 7.
Figure 9:
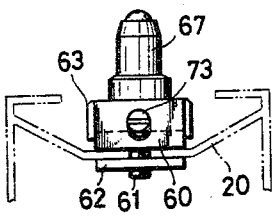
FIG. 9 is a side elevational view of the pivot mechanism, viewed from the right side of FIG. 8.
Figure 10:
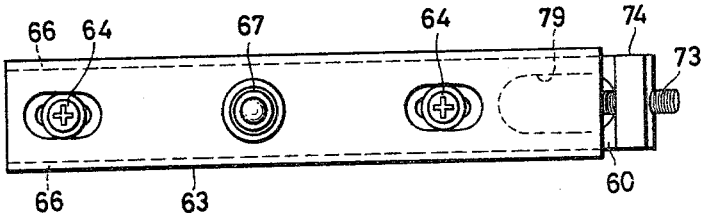
FIG. 10 is a top view of the pivot mechanism of FIG. 7.

A support plate 69 fixed to the lower frame member 26 (omitted for clarity in FIG. 7) of the window sash 18 has a socket 70 positioned in an opening 71 (FIG. 8) in the lower frame member 26, the socket 70 opening downwardly toward the slide base 63. The pivot shaft 67 is pivotally received in the socket 70 as best shown in FIG. 8. The lower frame member 26 is reinforced by a backup plate 72.

A threaded element or screw 73 threadedly extending through a vertical end wall 74 on the stationary base 60 has on its one end a pair of spaced annular flanges 75, 75 between which there are disposed a pair of arms 76, 76 projecting downwardly from the slide base 63, the arms 76, 76 being located one on each side of a smaller-diameter rod portion 77 of the screw 73 which extends between the flanges 75, 75. The screw 73 is inclined with respect to the general plane of the stationary base 60 so that the slotted end 78 of the screw 73 is directed obliquely upwardly. The stationary base 60 has adjacent to the end wall 74 a cavity 79 accommodating the double-flanged end of the screw 73. The sill 20 has an opening 80 (FIG. 8) which is in registration with the cavity 79 in the stationary base 60 for partly receiving the flanges 75, 75 on the screw 73.

The slide base 63 is longitudinally movable by turning the screw 73 between limits determined by the length of the slots 65, 65. Accordingly, the pivot shaft 67 is positionally adjustable in the longitudinal direction of the stationary base 60 and hence the sill 20.

In assembly, the stationary bases 29, 60 of the upper and lower pivot structures are screwed in substantial mutual alignment to the header 19 and the sill 20, respectively, of the window frame 17. Then, the slide bases 34, 63 are installed respectively onto the stationary bases 29, 60 with the screws 35, 36, 64 and 64 loosely attached to allow the longitudinal movement of the slide bases 34, 63 relative to the stationary bases 29, 60, respectively. At this time, the assembler should retract the screw 53 on the stationary base 29 of the upper pivot structure until the U-shaped recess 46 in the slide base 34 is held in a position as shown in FIG. 2 in which the recess 46 is completely out of alignment with the block 48 on the stationary base 29. The adjusting screw 73 on the stationary base 60 of the lower pivot structure is rotated in a desired direction to shift the slide base 63 longitudinally until the pivot shaft 67 reaches a selected position. With the pivot shaft 67 having been positionally adjusted, the screws 64, 64 are tightened to thereby secure the slide base 63 with respect to the stationary base 60.

Figure 11:
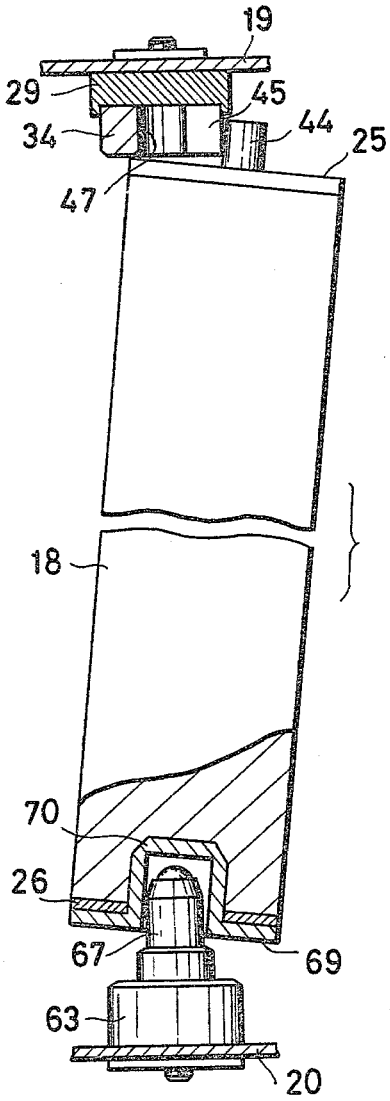
FIG. 11 is an enlarged elevational view of the pivoted window, partially in cross section, showing the way in which the window sash is installed into the window frame.

The window sash 18 is mounted within the window frame 17 by first fitting the socket 70 on the lower sash frame member 26 over the pivot shaft 67 on the lower pivot structure, and then moving the pivot shaft 67 on the upper sash frame member 25 sideways across the indentation 45 in the slide base 34 of the upper pivot structure and into the semicircular recess 46, as best shown in FIG. 11. After the window sash 18 has been swung out of flush alignment with the frame 17 to provide access to the screw 53 on the upper pivot structure, the screw 53 is turned to move the slide base 34 away from the end wall 52 on the stationary base 29 until the semicircular recess 46 which receives the pivot shaft 44 becomes aligned with and is closed by the block 48, thereby holding or trapping the pivot shaft 44 in the closed recess 46. The trapped pivot shaft 44 is positionally adjustable by moving the recess 46 out of exact alignment with the block 48 as long as the block 48 can retain the pivot shaft 44 in the recess 46. Finally, the slide base 34 is fixed to the stationary base 29 by tightening the screws 35, 36.

Figure 12:
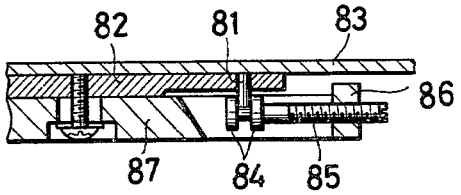
FIG. 12, appearing with FIG. 1, is a fragmentary cross-sectional view showing a modified pivot mechanism.

FIG. 12 shows a modified pivot structure that can be used as either the upper pivot mechanism 14 or the lower pivot mechanism 15. The modified pivot structure has a pair of arms 81 (only one illustrated) projecting from a stationary base 82 fixed to a window frame member 83, and a pair of annular flanges 84, 84 mounted on one end of an adjusting screw 85 threadedly extending through an end wall 86 of a slide base 87 that is movable relatively to the stationary base 82, the arms 81 being disposed between the flanges 84, 84 to prevent the screw 85 from axially moving as it is turned about its axis. Since the screw 85 is axially immovable, rotation of the screw 85 causes the end wall 86 of the slide base 87 to move thereon in the axial direction of the screw 85, thereby enabling the slide base 87 to shift longitudinally with respect to the stationary base 82.

Since each of the pivot structures thus far described has one adjusting screw 53, 73 or 85 only at its one end, the pivot structures can be located in an off-center position as shown in FIG. 1 such that the other end of the structure with no adjusting screw thereon may be positioned closely to one of the side jambs 21, 22 of the window frame 17.

Figure 13:
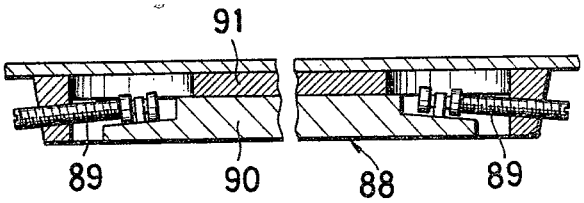
FIG. 13, appearing with FIG. 1, is a fragmentary cross-sectional view of another modification.

According to another modification illustrated in FIG. 13, a pivot structure 88 has a pair of adjustment screws 89, 89 at its both ends. With this arrangement, a slide base 90 is longitudinally moved relatively to a stationary base 91 by turning the screws 89, 89 in opposite directions at the same time. The modified structure 88 should be mounted centrally on the header 19 or sill 20 so as to provide a sufficiently large space behind each adjustment screw 89, 89 for easy access to such screws.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A pivot mechanism for use between a window frame member and a window sash edge which is pivotally movable relatively to the window frame member, said pivot mechanism comprising:

(a) a stationary base adapted to be secured to the window frame member;

(b) a slide base slidably mounted on said stationary base for pivotal engagement with the window sash edge;

(c) a threaded element threadedly extending through one of said bases substantially along the longitudinal direction of the window frame member;

(d) means coupling said threaded element with the other base while allowing rotation of said threaded element about its axis, whereby said slide base is movable relative to said stationary base in the longitudinal direction of the window frame member by turning said threaded element;

(e) means limiting the movement of said slide base relative to said stationary base and securing said slide base to said stationary base;

(f) a pivot shaft adapted to be mounted on the window sash edge and project toward the window frame member, said slide base being movable into a position in which said stationary and slide bases jointly provide bearing means for the pivot shaft;

(g) said bearing means comprising a curved wall on said slide base defining a substantially semicircular recess receiving said pivot shaft, and a flat surface on said stationary base, said flat surface closing said semicircular recess when said slide base is in said position, whereby said pivot shaft can be retained in said recess;

(h) said slide base including an elongated indentation extending in the direction in which the slide base is movable, said substantially semicircular recess opening toward said elongate indentation, and said flat surface on said stationary base being disposed in said elongate indentation.

2. A pivot mechanism for use between a window frame member and a window sash edge which is pivotally movable relatively to the window frame member, said pivot mechanism comprising:

(a) a stationary base adapted to be secured to the window frame member;

(b) a slide base slidably mounted on said stationary base for pivotal engagement with the window sash edge;

(c) a threaded element threadedly extending through one of said bases substantially along the longitudinal direction of the window frame member;

(d) means coupling said threaded element with the other base while allowing rotation of said threaded element about its axis, whereby said slide base is movable relative to said stationary base in the longitudinal direction of the window frame member by turning said threaded element;

(e) means limiting the movement of said slide base relative to said stationary base and securing said slide base to said stationary base;

(f) said coupling means comprising a pair of flanges mounted on and spaced axially of said threaded element, and a pair of arms projecting from said other base and disposed between said pair of flanges, said pair of arms sandwiching a rod portion of said threaded element which extends between said pair of flanges.

3. A pivot mechanism according to claim 2, said pair of arms projecting from said slide base.

4. A pivot mechanism according to claim 2, said pair of arms projecting from said stationary base.

* * * * *